US007360669B2

(12) United States Patent
Drajan

(10) Patent No.: US 7,360,669 B2
(45) Date of Patent: Apr. 22, 2008

(54) DISPENSER FOR SPHERICAL ARTICLES

(76) Inventor: Cornell Drajan, 976 Spicer Cove Rd., Hendersonville, NC (US) 28792

( * ) Notice: Subject to any disclaimer, the term of this patent is extended or adjusted under 35 U.S.C. 154(b) by 0 days.

(21) Appl. No.: 11/283,700

(22) Filed: Nov. 22, 2005

(65) Prior Publication Data

US 2007/0114238 A1 May 24, 2007

(51) Int. Cl.
*B65H 3/00* (2006.01)

(52) U.S. Cl. ..... 221/260; 221/263; 221/266; 221/288; 221/303; 221/270; 221/224; 221/236; 221/208

(58) Field of Classification Search ..... 221/1–312 C
See application file for complete search history.

(56) References Cited

U.S. PATENT DOCUMENTS

| | | | | |
|---|---|---|---|---|
| 2,086,296 | A | | 3/1937 | Gilbert |
| 2,605,892 | A | | 7/1952 | Waber |
| 2,645,336 | A | | 7/1953 | Waber |
| 2,653,706 | A | | 9/1953 | Aggson |
| 2,754,030 | A | | 7/1956 | Waber |
| 2,960,259 | A | | 11/1960 | Aveni |
| 3,018,921 | A | | 1/1962 | Hermanson |
| 3,319,827 | A | | 5/1967 | Englesson |
| 3,591,043 | A | | 7/1971 | Murphy |
| 4,354,619 | A | * | 10/1982 | Wippermann et al. ..... 221/263 |
| 4,492,316 | A | | 1/1985 | Emms |
| 4,502,612 | A | | 3/1985 | Morrison |
| 4,653,668 | A | | 3/1987 | Gibilisco |
| 5,054,647 | A | | 10/1991 | Yawata |
| 5,110,008 | A | * | 5/1992 | Moulding et al. ..... 221/259 |
| 5,123,574 | A | * | 6/1992 | Poulos ..... 222/362 |
| 5,147,101 | A | * | 9/1992 | Tiller ..... 294/19.2 |
| 5,405,047 | A | | 4/1995 | Hansen |
| 5,897,025 | A | | 4/1999 | Flewitt |
| 6,068,126 | A | | 5/2000 | DeJonge |
| 6,142,337 | A | * | 11/2000 | Schreckenberg et al. ... 221/263 |
| 6,581,799 | B1 | * | 6/2003 | Garrant et al. ..... 221/88 |
| 2003/0234260 | A1 | | 12/2003 | Giraud |
| 2004/0094567 | A1 | | 5/2004 | Pollock |
| 2004/0169049 | A1 | * | 9/2004 | Giraud ..... 221/263 |
| 2005/0205598 | A1 | * | 9/2005 | Gelardi ..... 221/263 |

* cited by examiner

*Primary Examiner*—Gene O. Crawford
*Assistant Examiner*—Michael K Collins
(74) *Attorney, Agent, or Firm*—Shoemaker and Mattare

(57) ABSTRACT

Spherical articles such as breath mints are released one at a time from a container by depressing a button, which simultaneously opens a first flow regulator and closes a second flow regulator in series with the first. When the button is released, the first flow regulator opens and the second flow regulator closes. The first flow regulator is preferably a pair of opposed weirs, and the second flow regulator is preferably a pair of parallel pillars.

2 Claims, 2 Drawing Sheets

DISPENSER FOR SPHERICAL ARTICLES

BACKGROUND OF THE INVENTION

This invention relates to a dispenser for small spherical articles such as breath mints, candies, BB's, ball bearings and the like.

Breath mints are commonly sold in a container having a mouth through which one can pour or dispense the mints. Some dispensers are adapted to dispense one article per manipulation. Most such dispensers have separate moving parts and are thus not economic to manufacture.

SUMMARY OF THE INVENTION

An object of the invention is to dispense spherical articles such as mints from a hand held container.

These and other objects are attained by a dispenser for spherical articles as described below. The spherical articles are sometimes referred to below simply as "balls" for word economy.

BRIEF DESCRIPTION OF THE DRAWINGS

In the accompanying drawings.

DESCRIPTION OF THE PREFERRED EMBODIMENT

Figure 1:
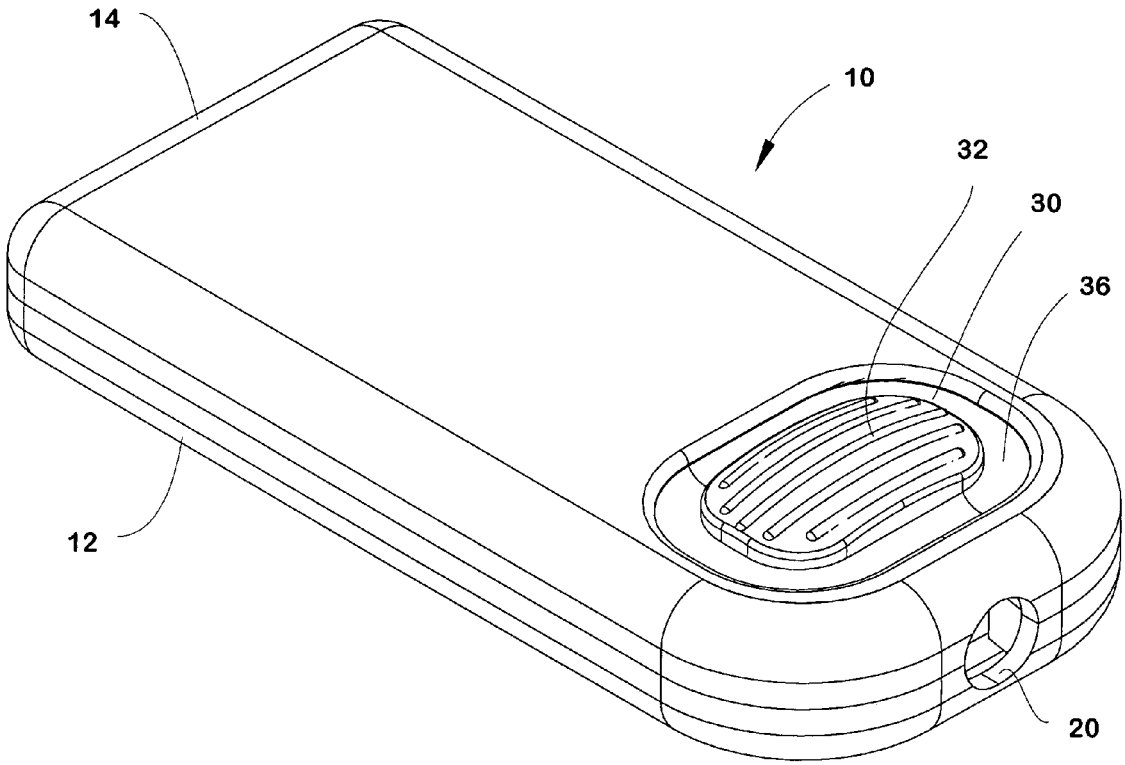
FIG. 1 is an isometric view of a dispenser for spherical articles.
Figure 3:
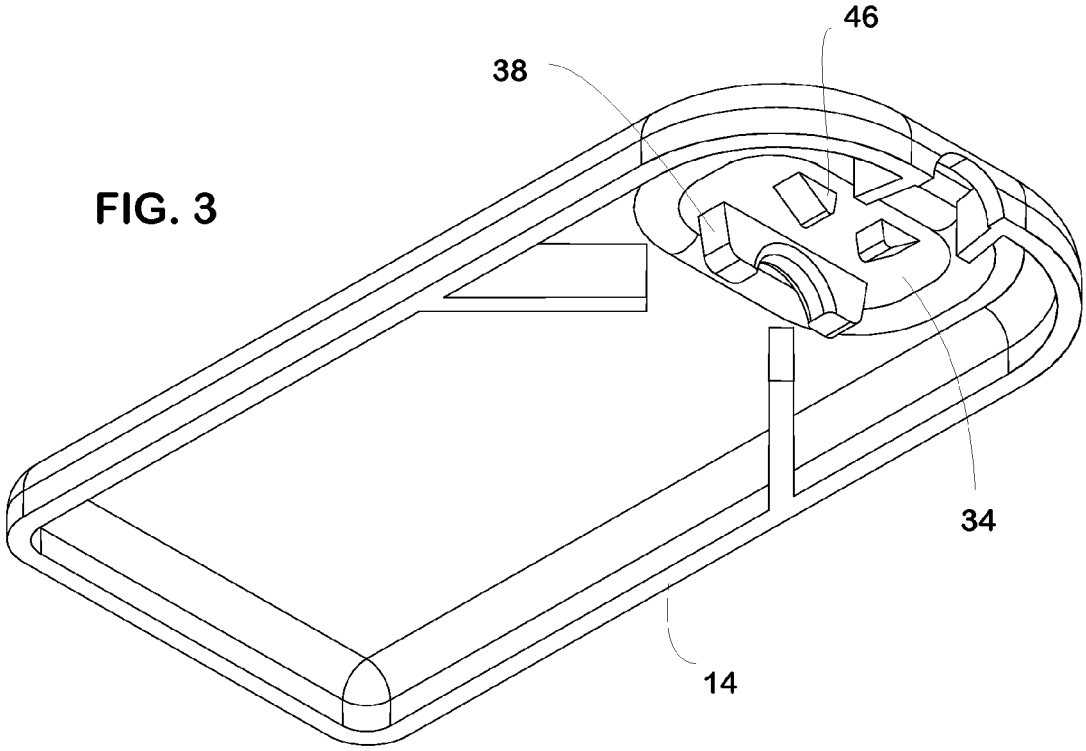
FIG. 3 is an isometric view, from below, of the top half of the dispenser.

A spherical article dispenser (FIG. 1) embodying the invention comprises a case 10 preferably made in two nearly identical halves. In the drawings, the bottom half is designated 12 and the top half is 14. Each half is molded from a flexible polymeric plastic such as polyethylene. The bottom half 12 comprises a flat panel 16 bounded by an upturned edge 18 which is interrupted only by a mouth 20 at the forward end of the container. A pair of converging guides tabs 22 (FIG. 2) molded integrally with the edge 18 lead articles to the mouth. A larger pair of converging guide bars 24 near the center of the panel define a reservoir 26 for containing a quantity of small spherical articles ("balls"). The spacing between the guide bars is such as to permit only one ball 'B' at a time to exit the reservoir.

Figure 2:
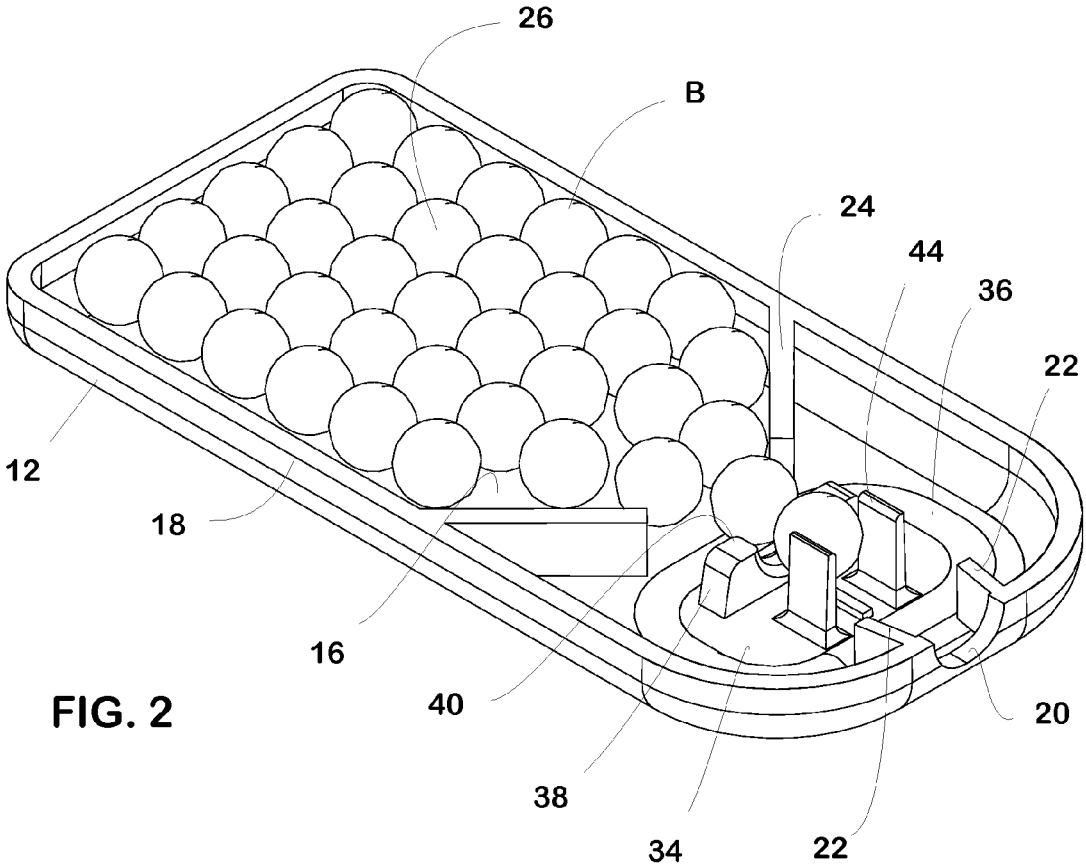
FIG. 2 is an isometric view of the dispenser, with its top half removed.

In FIG. 1, one can see the top of a button 30, at the forward end of the top half of the dispenser, that is pressed to release an article from the dispenser. The button illustrated has parallel ribs 32 on its outer surface, and is surrounded by a depressed band of material 36 which acts as a diaphragm, allowing the button to move inward somewhat when the button is pressed. The button and band are formed integrally with the rest of the dispenser half. The bottom half has a similar button, the inner (upper) surface 34 of which is visible in FIG. 2. The surrounding band is designated 36. Flow of the balls from the reservoir is regulated by a first flow regulator comprising a pair of identical weirs, one of which is designated by the numeral 38 in FIG. 2, the other of which is not shown. The weirs have an inner radius about equal to, or slightly large than, that of the spherical articles. Normally, the weirs are spaced sufficiently as not to prevent articles from passing between them. But when either or both buttons are pressed, the weirs are closed enough to prevent balls from passing between them. Their flats 40 meet when the buttons are pressed sufficiently, preventing further movement which might overstress the band material.

Downstream of the weirs, about one ball diameter, is a second flow regulator comprising a pair of flexible pillars 44 that extend upward from the button surface 34. The pillars, when relaxed, have a spacing slightly less than one ball diameter, preventing the foremost ball from reaching the mouth. However, the pillar spacing may be increased by the action of a pair of wedges 46 molded to the bottom of the top button. When the button is pressed sufficiently, the wedges drive the tops of the pillars apart to a point where the pillar spacing is equal to or greater than the ball diameter, releasing the foremost ball, which (provided the dispenser is tilted downward) allows the ball to fall toward and exit through the mouth of the dispenser. More than one ball cannot be dispensed, however, because when the button is pressed, the weirs close and prevent more balls from passing. So at all times, the path is blocked by either the weirs or the pillars, but not both. As a consequence, only one ball is dispensed per button depression.

It is essential, if only one ball is to be released at a time, that only a single ball fit in the distance between the first and second regulators. Of course, one could design a dispenser to release two, or any number of balls at a time by increasing the distance suitably.

Although the balls have been described as mints, they could be any spherical item, such as ammunition balls, marbles, beads or the like.

The materials and dimensions of the dispenser will depend on the diameter and quantity of the articles to be dispensed, and the depression force desired to effect dispensing. These are matters of ordinary design skill.

It presently seems most convenient to make the dispenser from two nearly identical halves; however, other constructions are possible, such constructions being matters of design choice within the scope of this invention. It is also possible to make the invention with a button on only one side of the dispenser, or to make the buttons merely flexible areas of the housing which can be pressed upon with the same effect as described above.

Since the invention is subject to modifications and variations, it is intended that the foregoing description and the accompanying drawings shall be interpreted as only illustrative of the invention defined by the following claims.

I claim:

1. A dispenser comprising a container defining a reservoir for holding a plurality of balls, a container mouth for releasing balls from the container, a flow path extending from the reservoir to the container mouth, a first ball flow regulator disposed in said path, a second ball flow regulator disposed in said path in series with said first ball flow regulator, each of said first and second ball flow regulators being capable of blocking flow of balls along the path, and means for simultaneously operating said first and second regulators, said regulators being designed so that one, but not both, of the regulators blocks ball flow at any time, wherein the operating means comprises at least one button which is depressed to operate the regulators wherein the first regulator comprises a first pair of elements which normally permit ball flow, but move closer together, to block ball flow, when the button is depressed, wherein each element of said first pair is a weir, and wherein each weir has a pair of flats which act as stops when the flats engage flats on the other weir.

2. A dispenser comprising a container defining a reservoir for holding a plurality of balls, a container mouth for releasing balls from the container, a flow path extending from the reservoir to the container mouth, a first ball flow regulator disposed in said path, a second ball flow regulator disposed in said path in series with said first ball flow regulator, each of said first and second ball flow regulators being capable of blocking flow of balls along the path, and a button for simultaneously operating said first and second regulators, said regulators being designed so that one, but not both, of the regulators blocks ball flow at any time, the button being formed integrally with sides of the container, wherein the first regulator comprises a first pair of elements which normally permit ball flow, but move closer together, to block ball flow, when the button is depressed, and the second regulator comprises a second pair of elements which normally block ball flow, but which move further apart, to permit ball flow, when the button is depressed, wherein each element of said second pair is a flexible pillar, said pillars being substantially parallel and fixed at one end to a wall of said container.

* * * * *